US005114016A

United States Patent [19]

Todd

[11] Patent Number: 5,114,016

[45] Date of Patent: May 19, 1992

[54] CEILING FAN DISPLAY STAND

[76] Inventor: Alvin E. Todd, P.O. Box 924, Pigeon Forge, Tenn. 37868-0924

[21] Appl. No.: 549,607

[22] Filed: Jul. 9, 1990

[51] Int. Cl.[5] ..... A47F 7/00

[52] U.S. Cl. ..... 211/26; 211/206; 416/246

[58] Field of Search ..... 211/26, 204, 206; 108/50, 24; 269/289 R; 98/1, 31.5; 416/246

[56] References Cited

U.S. PATENT DOCUMENTS

| | | | |
|---|---|---|---|
| 493,305 | 3/1893 | Sherman | 416/246 |
| 892,218 | 6/1908 | Brumberg et al. | 211/163 X |
| 1,506,419 | 8/1924 | Fielding | 211/26 |
| 2,321,324 | 6/1943 | Schwab | 108/50 X |
| 2,812,988 | 11/1957 | Kohl | 108/50 |
| 3,228,317 | 1/1966 | Westman | 98/1 |
| 3,341,028 | 9/1967 | Nichols | 211/204 |
| 3,379,434 | 4/1968 | Guzaldo | 108/50 X |
| 3,406,645 | 10/1968 | Monroe | 108/50 X |
| 3,447,488 | 6/1969 | Lehrman | 108/50 |
| 3,620,377 | 11/1971 | Holtz | 211/206 |

*Primary Examiner*—Carl D. Friedman
*Assistant Examiner*—Korie H. Chan
*Attorney, Agent, or Firm*—Pitts & Brittian

[57] ABSTRACT

A light-weight, portable, collapsible display stand for displaying a product or device, such as a ceiling fan, in a dynamic operating environment. Vertical supports are removably attached at the ends of a folding table, with a horizontal support at the upper ends of the vertical supports. An appliance, such as a ceiling fan, is removably attached to the upper horizontal support where it can be operated safely out of reach, with its effects being both seen and felt. An electrical power cable is run through one of the vertical supports and the horizontal support to the appliance mounted thereon.

7 Claims, 4 Drawing Sheets

CEILING FAN DISPLAY STAND

TECHNICAL FIELD

This device relates to display stands in general, and more particularly concerns a light-weight, portable, collapsible display stand for aiding in the demonstration of merchandise for sale, especially dynamic operating devices, such as ceiling fans, for instance, or for other applications, such as for teaching/training.

BACKGROUND ART

It is often useful to be able to display dynamic merchandise, such as a ceiling fan, at flea markets, crafts fairs and the like. An item of merchandise is much more likely to get the attention of the consumer if it can be displayed in a fashion that allows the consumer to see the merchandise function in its natural manner. In order to display this type of merchandise in places other than department stores or shopping centers it is highly desirable for a display stand to be able to support the weight of a ceiling fan and still be lightweight enough to be portable. To aid in the transportability of the stand it is desirable for the stand to be constructed in a manner that facilitates ease of assembly and disassembly.

Accordingly, it is a principal object of the present invention to provide a portable stand for the display of dynamic merchandise devices, such as a ceiling fan, for sale or for training/teaching purposes.

It is also an object of the present invention to provide such a display stand which is easily disassembled/reassembled, and requires only a relatively small amount of storage space.

It is also an object of the present invention to provide such a display stand which is strong enough to support weights of several hundred pounds. It is a further object of the present invention to provide such a display stand with a portion thereof serving as a workbench surface.

Other objects and advantages over the prior art will become apparent to those skilled in the art upon reading the detailed description together with the drawings as described as follows.

DISCLOSURE OF THE INVENTION

In accordance with the various features of this invention, a portable, collapsible display stand for the displaying of certain devices, such as ceiling fans or other such apparatuses which are best displayed in a fashion that allows the displayed apparatus to be operated, is provided. Two long, vertical members support a horizontal member at the vertical members' upper ends. An appliance, such as an electric ceiling fan, for instance, can be attached to the horizontal member. An adapter frame is attached to each of the vertical members' lower ends, with a pair of horizontally stabilizing legs attached to each adapter frame. A diagonal locking hinge-brace extends from the adapter frame upwardly to brace and support a horizontal work surface. Electrical wiring for powering the appliance can be run inside the long vertical members and the horizontal member, or attached to the outer surfaces thereof. The long vertical members 5 and the upper horizontal support member can be made of polyvinyl chloride (PVC), or such like material. The adapter frame can be comprised of a section of plywood, for instance, of approximately two feet on each side. It is attached to the horizontal stabilizing legs and the vertical uprights by U-shaped conduit clamps, in the preferred embodiment.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
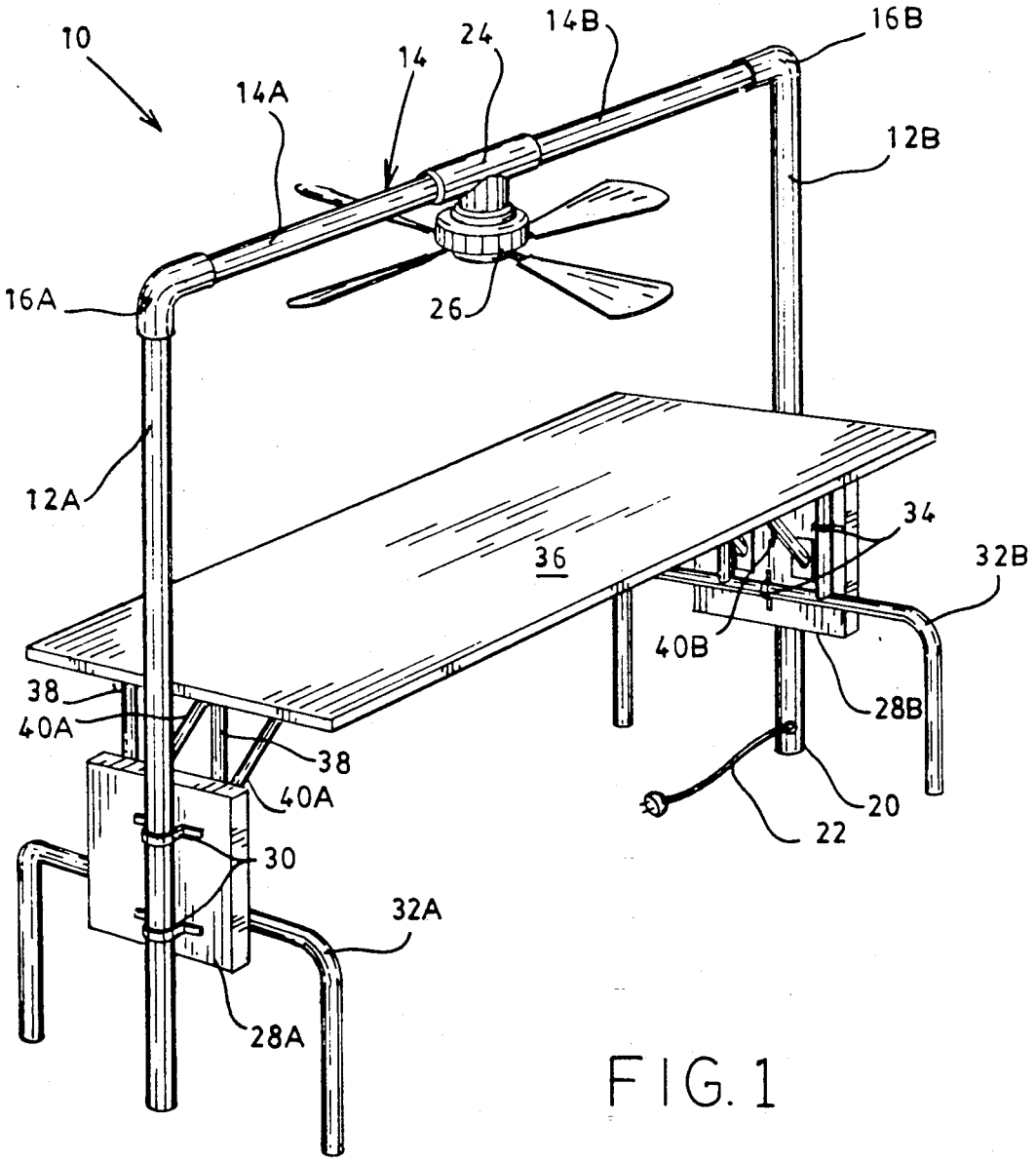
FIG. 1 is a perspective view of a ceiling fan display stand constructed in accordance with various features of the present invention.

In accordance with the various features of the present invention, a stand for supporting certain electrically operated hanging appliances, such as ceiling fans, is provided which comprises upright support members for carrying a horizontal support member, a horizontal support member attached to the upright support members. The horizontal support member has provisions for attaching an electrically operated hanging appliance, such as a ceiling fan. The stand also incorporates a power supply which allows the electrically operated hanging appliance to be operated in a fashion which emulates its natural function. In the illustrated embodiment, a stand for supporting certain electrically operated hanging appliances, such as ceiling fans, is illustrated generally at 10. In FIG. 1, first vertical support members 12A and 12B support a first horizontal support member 14 at the upper distal ends thereof. Vertical support members 12A and 12B, in a preferred embodiment, can be lengths of rigid polyvinyl chloride (PVC) tubing, three inches in diameter, and ten feet long, for example. Ninety degree elbow members 16A and 16B are attached to the distal ends of vertical members 12A and 12B, respectively, for the purpose of receiving the ends of first horizontal support member 14. The attaching of ninety degree elbow members 16A and 16B can be by gluing, the use of threaded members, nuts and bolts, or any other attaching means well-known to those with expertise in the art. A port 20 is provided in one of the vertical members 12 to accommodate an electrical power cable 22. In the preferred hollow PVC tubing embodiment, an electric power cable 22 (if used) can be routed through the interior of at least one of the vertical members 12 and into a horizontal support member 14. Of course, electric power cable 22 could also be attached to the outside surface of various members of the present invention, if desired.

Horizontal support member 14, in a preferred embodiment, is also composed of three inch PVC, in two three-foot lengths, 14A and 14B, joined together at the center by a tee fitting 24. First horizontal member 14 is supported at each end by ninety degree elbow members 16A and 16B, attached to first vertical support members 12A and 12B, respectively. An appliance to be displayed 26 is attached to the tee fitting 24 of horizontal member !4. Any of various attaching and supporting mechanisms can be employed for this purpose without departing from the spirit and scope of the present invention. Tee fitting 24 can be attached to the ends of horizontal support members 14A and 14B by gluing, threaded members, nuts and bolts, or other attaching means, as desired. Those with expertise in the art will see that horizontal member 14 can also be a single length, having attaching means at its approximate center instead of a tee fitting, for instance.

Figure 2:
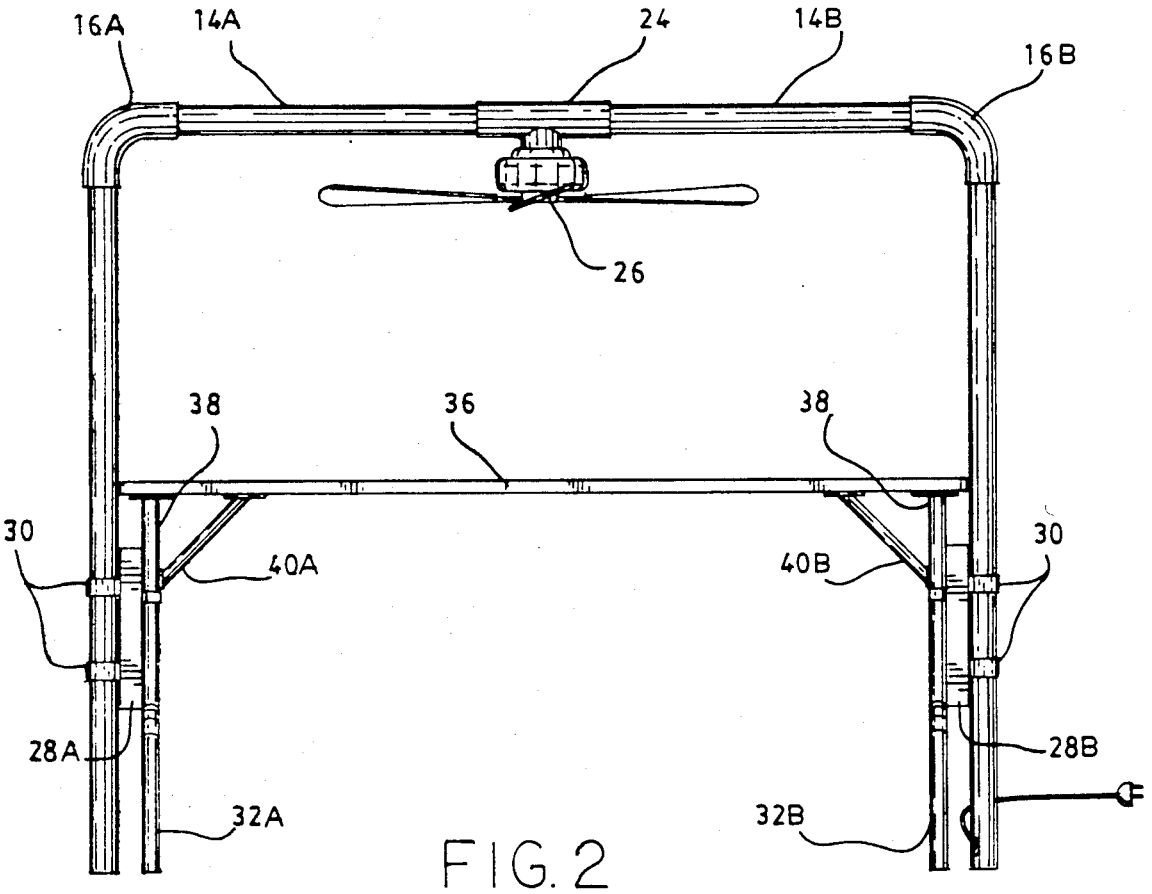
FIG. 2 is a side view of the device of FIG. 1.
Figure 3:
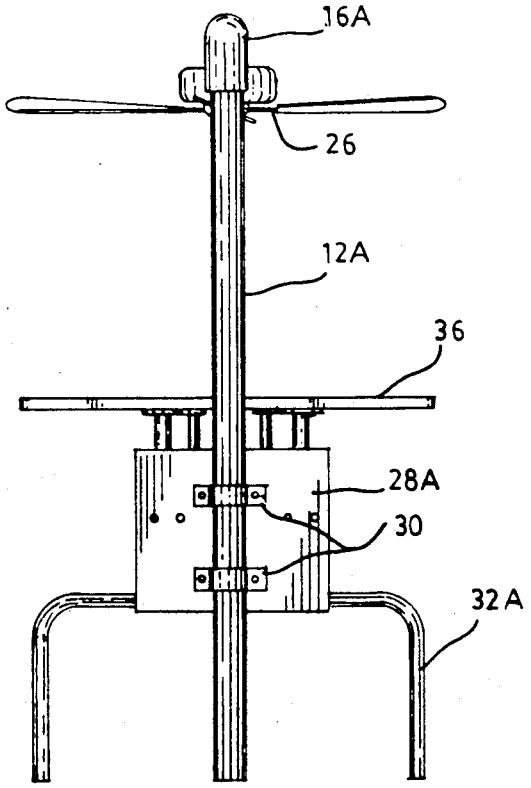
FIG. 3 is an end view of the device of FIG. 1.

Adapter plates 28A and 28B are attached to vertical support members 12A and 12B respectively, by conduit clamps 30, which are shown in FIGS. 1, 2, and 3. Adapter plates 28A and 28B, in turn, have attached to them the horizontal stabilizing legs 32A and 32B, best seen in FIG. 5, secured by conduit clamps 34. Conduit clamps 34 are of a smaller size as conduit clamps 30.

Figure 5:
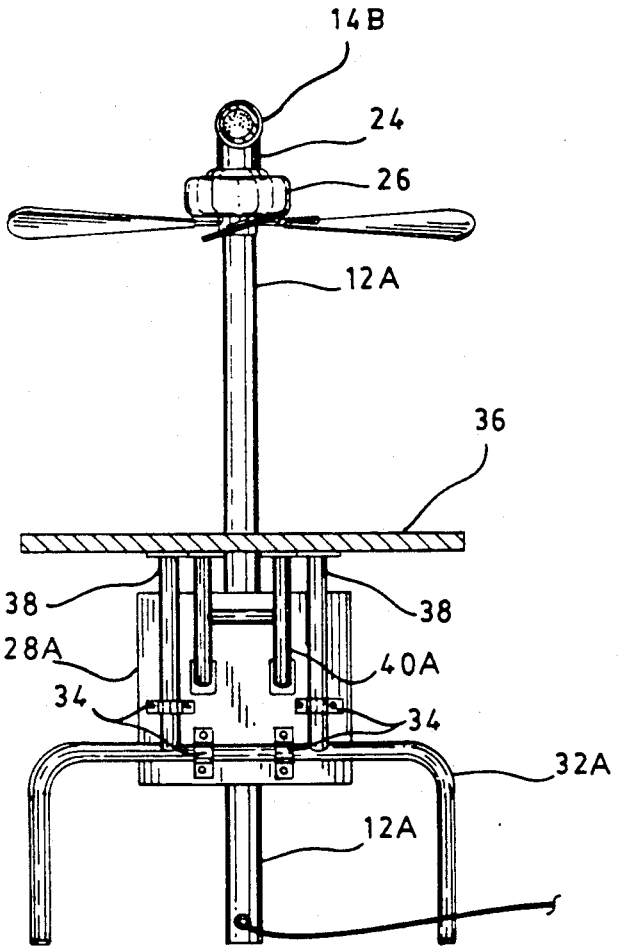
FIG. 5 is a detailed view of the adapter panel of the device of FIG. 1.

In FIG. 5, horizontal work surface 36 is supported by vertical rods 38 which rest on and can be attached to legs 32. Diagonal hinge-braces 40A and 40B also support surface 36 by bracing each end of it against adapter plates 28A and 28B. Of course, it will be seen by those with expertise in the art that many other embodiments are possible and that the one described is only a representative example.

Figure 4:
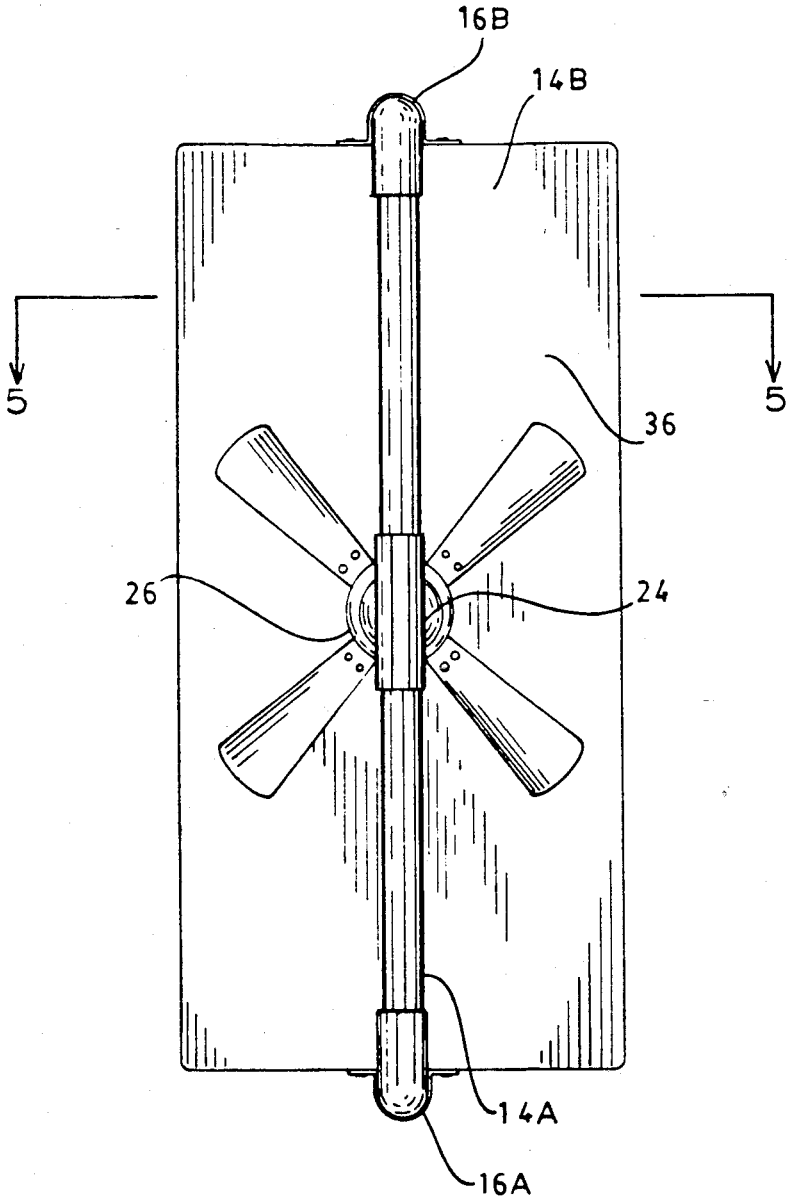
FIG. 4 is a top view of the device of FIG. 1.

The top view of FIG. 4 clearly discloses the clearance necessary between vertical supports 12 for the blades of the ceiling fan used as the representative appliance 26.

The device 10 can be quickly assembled in a minimum of space on a showroom floor, 0 sidewalk sale, or other such desired location. In fact, such a device 10 can be created onsite by purchasing ordinary hardware items and a table, obviating the necessity of transporting such a display device to a very distant site, such as to another city or state, for example. An appliance 24 to be demonstrated/displayed can be attached to upper horizontal support member 14 and empowered by electrical cable 22, which can be attached to an extension cord, if a source of electrical power is not adjacent to the site. In this manner, prospective customers can see and feel the particular attributes of the appliance while it is in operation.

From the foregoing description, it will be recognized by those skilled in the art that a ceiling fan display offering advantages over the prior art has been provided. Specifically, the ceiling fan display provides a portable stand for the display of dynamic merchandise devices, such as a ceiling fan, for sale or for training/teaching purposes; a display stand which is easily disassembled/-reassembled, and requires only a relatively small amount of storage space; a display stand which is strong enough to support weights of several hundred pounds; and a display stand with a portion thereof serving as a workbench surface.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A ceiling fan display stand in combination with a ceiling fan, said stand comprising:

a substantially planar work surface with first and second ends and front and back edges, said substantially planar work surface being substantially parallel to the ground whereby said substantially planar work surface is readily accessible from said front edge and said back edge, thereby providing a table or a workbench;

upright support members spatially separated from each other, said upright support members being disposed proximate each of said first and second ends of said substantially planar work surface and is located substantially quidistantly from said front and back edges;

a horizontal support member for supporting said ceiling fan said horizontal support member being attached to said upright support members and being vertically separated from said substantially planar work surface such that a volume surrounding and proximate to said ceiling fan is unobstructed such that said ceiling fan is unencumbered to operate in a fashion which emulates its natural function;

attaching means carried by said horizontal support member for attaching said ceiling fan to said horizontal support member; and a power supply for energizing said ceiling fan whereby said ceiling fan may be operated.

2. The ceiling fan display stand of claim 1 wherein said attaching means is located on said horizontal support member at a point approximately equidistant from each of said upright support members.

3. The ceiling fan display stand of claim 1 wherein said ceiling fan display stand further comprises means to support said substantially planar work surface.

4. The ceiling fan display stand of claim 1 wherein said ceiling fan display stand further comprises a ceiling fan having blades.

5. The ceiling fan display stand of claim 1 wherein said power supply comprises electrical wiring carried by at least one of said upright support members and said horizontal support member to a point proximate said attaching means, said electrical wiring terminating in at least one connector for empowering said ceiling fan; and means for electrically energizing said electrical wiring.

6. The ceiling fan display stand of claim 1 wherein said horizontal support member is releasably attached to said upright support members facilitating ease of assembly, disassembly and portability.

7. A ceiling fan display stand, said stand comprising:

a ceiling fan having blades;

a substantially planar work surface with first and second ends and front and back edges, said substantially planar work surface being substantially parallel to the ground whereby said substantially planar work surface is readily accessible from said front edge and said back edge, thereby providing a table or a workbench;

a support means for supporting said substantially planar work surface;

upright support members fabricated from a hollow rigid material, spatially separated from each other for supporting said ceiling fan, said upright support members being disposed proximate each of said first and second ends of said substantially planar work surface and are located substantially equidistantly from said front and back edges;

a horizontal support member fabricated from a hollow rigid material, said horizontal support member being releasably attached to said upright support members and being vertically separated from said substantially planar work surface such that a volume surrounding and proximate to said ceiling fan is unobstructed such that said ceiling fan is unencumbered to operate in a fashion which emulates its natural function;

attaching means carried by said horizontal support member for attaching said ceiling fan to said horizontal support member, said attaching means being located on said horizontal support member at a point approximately equidistant from each of said upright support members; and a power supply for energizing said ceiling fan whereby said ceiling fan may be operated, said power supply including electrical wiring carried by at least one of said upright support members and said horizontal support member to a point proximate said attaching means, said electrical wiring terminating in at least one connector for empowering said ceiling fan.

* * * * *